US011718057B2

(12) United States Patent
Mardikian

(10) Patent No.: US 11,718,057 B2
(45) Date of Patent: Aug. 8, 2023

(54) APPARATUS FOR PRESSING AND DEHYDRATING OF WASTE

(71) Applicant: Regreen Technologies, Inc., Santa Ana, CA (US)

(72) Inventor: Albert Avedis Mardikian, Corona Del Mar, CA (US)

( * ) Notice: Subject to any disclaimer, the term of this patent is extended or adjusted under 35 U.S.C. 154(b) by 914 days.

(21) Appl. No.: 16/411,415

(22) Filed: May 14, 2019

(65) Prior Publication Data

US 2019/0263080 A1 Aug. 29, 2019

Related U.S. Application Data

(62) Division of application No. 15/048,513, filed on Feb. 19, 2016, now Pat. No. 10,919,249.

(51) Int. Cl.

| | |
|---|---|
| ***B30B 9/16*** | (2006.01) |
| ***F26B 17/20*** | (2006.01) |
| ***B30B 9/26*** | (2006.01) |
| ***B30B 9/12*** | (2006.01) |
| ***F26B 5/14*** | (2006.01) |

(52) U.S. Cl.

CPC ..... *B30B 9/16* (2013.01); *B30B 9/121* (2013.01); *B30B 9/26* (2013.01); *F26B 5/14* (2013.01); *F26B 17/20* (2013.01); *F26B 2200/04* (2013.01); *F26B 2200/12* (2013.01)

(58) Field of Classification Search

CPC ..... F26B 5/14; F26B 17/20; F26B 2200/04; F26B 2200/12; B30B 9/16; B30B 9/121; B30B 9/26

USPC ..... 32/182

See application file for complete search history.

(56) References Cited

U.S. PATENT DOCUMENTS

| | | | | |
|---|---|---|---|---|
| 3,111,080 A | | 11/1963 | French et al. | |
| 3,707,070 A | | 3/1972 | Chaplin | |
| 3,849,327 A | * | 11/1974 | DiSalvo | C11D 3/0036 510/351 |

(Continued)

FOREIGN PATENT DOCUMENTS

| | | |
|---|---|---|
| CA | 1040419 A | 10/1978 |
| CA | 1129210 | 8/1982 |

(Continued)

OTHER PUBLICATIONS

Regreen1-10AU; Australian Patent Application 2020204230 Examiner Report dated Feb. 25, 2021.

(Continued)

*Primary Examiner* — Stephen M Gravini
(74) *Attorney, Agent, or Firm* — Patent Law Agency, LLC; Peter Ganjian

(57) ABSTRACT

Apparatus for pressing and drying a pre-defined amount of waste includes a metal main frame positioned to provide rigid support, and a body mechanically linked to the main frame through a plurality of linkage plates. The apparatus also includes an inlet vertically mounted on the body and a twin screw assembly to press and dehydrate the pre-defined amount of waste. A plurality of mesh screens is rigidly linked to the main frame along the longitudinal axis of the apparatus to remove compressed liquid. The body is also designed to support rotation of the twin screw assembly, and the inlet includes an ingress cross-sectional opening to receive the pre-defined amount of waste.

12 Claims, 11 Drawing Sheets

(56) References Cited

U.S. PATENT DOCUMENTS

| | | | | | |
|---|---|---|---|---|---|
| 3,862,887 | A * | 1/1975 | Bielski | C10L 5/46 | 201/2.5 |
| 3,918,915 | A * | 11/1975 | Holler, Jr. | B01D 53/50 | 422/177 |
| 3,923,097 | A | 12/1975 | Hovad | | |
| 3,979,104 | A | 9/1976 | LaCoste et al. | | |
| 4,074,751 | A | 2/1978 | Ducasse | | |
| 4,346,523 | A | 8/1982 | Ronning | | |
| 4,644,664 | A | 2/1987 | Bradshaw | | |
| 4,864,942 | A * | 9/1989 | Fochtman | C02F 11/004 | 110/341 |
| 4,872,998 | A | 10/1989 | Dausman et al. | | |
| 4,982,514 | A | 1/1991 | Ullum | | |
| 4,993,943 | A | 2/1991 | Norris | | |
| 5,651,305 | A | 7/1997 | Bushman et al. | | |
| 5,972,403 | A | 10/1999 | Tiller | | |
| 7,267,049 | B2 | 9/2007 | Babbini | | |
| 7,520,457 | B1 | 4/2009 | Poitras | | |
| 8,544,289 | B2 | 10/2013 | Johnson et al. | | |
| 9,068,124 | B2 * | 6/2015 | Spence | C10G 1/047 | |
| 9,567,245 | B2 | 2/2017 | Jenkins et al. | | |
| 9,744,574 | B2 | 8/2017 | Cathcart | | |
| 10,364,394 | B2 | 7/2019 | Strezov | | |
| 10,723,665 | B1 * | 7/2020 | Shirley, Jr. | C05C 1/00 | |
| 10,919,249 | B2 * | 2/2021 | Mardikian | F26B 5/14 | |
| 11,041,633 | B2 | 6/2021 | Rosen | | |
| 11,229,741 | B2 | 1/2022 | Diianni et al. | | |
| 2004/0172996 | A1 | 9/2004 | Matsui | | |
| 2005/0217133 | A1 | 10/2005 | Yakumaru et al. | | |
| 2006/0130353 | A1 | 6/2006 | Eloo | | |
| 2006/0272518 | A1 | 12/2006 | Babbini | | |
| 2006/0288884 | A1 | 12/2006 | Babbini | | |
| 2008/0184587 | A1 | 8/2008 | Shivvers | | |
| 2009/0053074 | A1 | 2/2009 | Babicki et al. | | |
| 2009/0060779 | A1 | 3/2009 | Chambe et al. | | |
| 2009/0294270 | A1 * | 12/2009 | Shuman | C10G 1/02 | 201/34 |
| 2010/0043246 | A1 | 2/2010 | Smith et al. | | |
| 2010/0016339 | A1 | 7/2010 | Michalek et al. | | |
| 2010/0163396 | A1 | 7/2010 | Michalek et al. | | |
| 2013/0199383 | A1 | 8/2013 | Horton et al. | | |
| 2013/0205613 | A1 * | 8/2013 | Mardikian | F26B 19/005 | 34/385 |
| 2014/0144823 | A1 | 5/2014 | Marchesini et al. | | |
| 2014/0224136 | A1 | 8/2014 | Bollinger | | |
| 2015/0276312 | A1 | 10/2015 | Mardikian | | |
| 2019/0263080 | A1 * | 8/2019 | Mardikian | B30B 9/121 | |
| 2020/0094260 | A1 * | 3/2020 | Mardikian | B30B 15/34 | |
| 2020/0164381 | A1 * | 5/2020 | Mardikian | B30B 9/12 | |
| 2020/0331818 | A1 * | 10/2020 | Shirley, Jr. | C05B 7/00 | |
| 2022/0053672 | A1 | 2/2022 | Krietzman | | |

FOREIGN PATENT DOCUMENTS

| | | | | | |
|---|---|---|---|---|---|
| CA | 2656901 | | 1/2008 | | |
| CA | 2662144 | | 4/2008 | | |
| CA | 2877382 | | 12/2012 | | |
| CA | 2877382 | A1 | 12/2012 | | |
| CA | 3011571 | A1 * | 8/2017 | B30B 9/121 | |
| CN | 1170863 | | 2/2001 | | |
| CN | 2690826 | | 4/2005 | | |
| CN | 10121624 | A | 7/2008 | | |
| CN | 101216242 | | 4/2009 | | |
| CN | 102235808 | | 11/2011 | | |
| CN | 202762719 | | 3/2013 | | |
| CN | 202762719 | U | 3/2013 | | |
| EP | 2977668 | A1 | 1/2016 | | |
| GB | 397666 | | 8/1933 | | |
| GB | 1383690 | | 2/1975 | | |
| GB | 1581859 | | 12/1980 | | |
| JP | S56151872 | A | 11/1981 | | |
| JP | S61212343 | A | 9/1986 | | |
| JP | 07009479 | A * | 1/1995 | | |
| JP | 2000325914 | A | 11/2000 | | |
| JP | 2001-030096 | | 2/2001 | | |
| JP | 2001-116457 | A | 4/2001 | | |
| JP | 2003-025097 | | 7/2008 | | |
| JP | 2013-059781 | | 4/2013 | | |
| JP | 2015024366 | | 2/2015 | | |
| JP | 6814363 | B2 * | 1/2021 | B30B 9/121 | |
| KR | 20080024953 | | 3/2008 | | |
| KR | 20100103148 | | 9/2010 | | |
| KR | 20080024953 | A | 3/2018 | | |
| WO | WO83/00303 | | 2/1983 | | |
| WO | WO 91/06816 | | 5/1991 | | |
| WO | WO2004022510 | A1 | 8/2003 | | |
| WO | WO2004022510 | | 3/2004 | | |
| WO | WO 2006060122 | | 8/2006 | | |
| WO | WO-2017142592 | A1 * | 8/2017 | B30B 9/121 | |

OTHER PUBLICATIONS

Office Action for Case Regreen1-4CN from China Patent Office dated Jun. 21, 2021; Includes the Above Citations.

Australian Patent Application No. 2020204230 ; Notice of Acceptance dated Jul. 30, 2021.

Office Action from Australian Patent Office dated Jun. 24, 2021 for Australian Patent Application 2020204243.

Australian Patent Application Office Action for Australian Patent Application: 2016388325; dated Apr. 4, 2019.

Australian Patent Application Office Action for Australian Patent Application: 2016393244; dated Apr. 4, 2019.

Office Action from Japan Case 2018-537656; dated Oct. 12, 2020; See U.S. Appl. No. 15/436,554, filed Feb. 17, 2017 and U.S. Appl. No. 16/774,600, filed Jan. 28, 2020 and U.S. Appl. No. 16/669,752, filed Oct. 31, 2019.

Office Action from India case 201827029605; dated Oct. 26, 2020; See U.S. Appl. No. 15/001,091, filed Jan. 19, 2016.

European Search Report for Application EP21155303.7; dated Jun. 1, 2021.

European Patent Applicatin Office Action EP21155303.7 ; dated Jun. 1, 2021.

European Search Report Information on Search Strategy for Application EP21155303.7; dated Jun. 1, 2021.

European Patent Applicatin Office Action EP21155426.6 ; dated Jun. 1, 2021.

European Search Report for Application EP21155426.6; dated Jun. 1, 2021.

European Search Report Information on Search Strategy for Application EP21155426.6; dated Jun. 1, 2021.

India Patent Application: 201827029605 Offic Action; dated Oct. 26, 2020.

Vietnam Patent Application: 1-2018-03531 Office Action; dated Mar. 31, 2021.

Saudi Arabia IP Patent Application: 518392055 Office Action; dated Aug. 18, 1442 (Islamic Date).

Saudi Arabia IP Patent Application: 518392222 Office Action; dated Aug. 18, 1442 (Islamic Date).

Examination Report from Australian Patent Office Regrading Australian Patent Application 2017221474; dated May 16, 2019; (U.S. Appl. No. 15/436,554 to Albert Mardikian).

Regreen1-4VN Office Action fromk Vietnam for Case 1-2018-03532 dated Jan. 27, 2022.

Regreen1-3AE Office Action dated Jun. 30, 2022 United Arabe Emirates.

Regreen1-4AE Office Action dated Aug. 25, 2022 United Arabe Emirates.

Regreen1-4SA Office Action dated Nov. 7, 2021 Kingdom of Saudi Arabia.

Regreen1-10JP Office Action dated Jan. 12, 2022 ; Japan.

Regreen1-11AU Office Action dated Jun. 24, 2022; Australia.

Regreen1-12JP Office Action dated Mar. 24, 2022; Japan.

Regreen1-6VN Office Action dated Jan. 27, 2022 ; Vietnam.

Regreen1-3MX Office Action dated Jun. 1, 2022 ; Mexico.

Regreen1-4MX Office Action dated Jun. 22, 2022; Mexico.

Regreen1-6MX Office Action dated Jun. 23, 2022 ; Mexico.

(56) References Cited

OTHER PUBLICATIONS

Regreen1-10CA Office Action dated Jun. 7, 2022; Canada, Includes Related Cases (Box II: family Prosecution); Search History with cited art of interest and Questel-orbit Art of Interest.
www.tacmak.com; Tac Makina—Fish Meal and Oil Production Equipment Brouchure; http://www.tacmak.com/en/home/http://www.tacmak.com/wp-content/uploads/katalog/Balik_Unu_Yagi_Uretim_Makinalari.pdf Last Visited: Jun. 14, 2022.
https://www.hskatikenerji.com/homepage/https://www.hskatikenerji.com/hst-double-shaft-shredder-systems, Last Visited: Jun. 14, 2022.
https://has-makina.com.tr/; and https://has-makina.com.tr/indexe3fa.html?option=com_content&view=article&id=88&Itemid=216 Last Visited: Jun. 14, 2022.
https://www.fjelltg.no/solutionCategory/2020-02-08-protein-recycling/ Last Visited: Jun. 14, 2022.
https://bhxinhong.en.ecplaza.net/ Last Visited: Jun. 14, 2022.
https://www.amisyfoodmachine.com/food-machinery/fish-meal-production-line.html Last Visited: Jun. 14, 2022.
Regreen1-3AE: United Arab Emirate office action, including Examination report, search report, Substantive Examination ; dated Jan. 2022.
Regreen1-4AE: United Arab Emirate office action, including Examination report, search report, Substantive Examination ; dated Jan. 2022.
Regreen1-10JP: 2020-190338 Japan office action; dated Jan. 12, 2022.
Regreen1-10US; U.S. Appl. No. 16/411,415, filed May 14, 2019 Office Action dated Apr. 18, 2022.
Regreen1-4VN Office Action from Vietnam for Case 1-2018-03532 dated Jan. 27, 2022.

* cited by examiner

APPARATUS FOR PRESSING AND DEHYDRATING OF WASTE

CROSS-REFERENCE TO RELATED APPLICATIONS

This Application is a DIVISIONAL Non-Provisional Utility Patent Application that claims the benefit of priority of the co-pending U.S. Non-provisional Utility patent application Ser. No. 15/048,513 with filing date 19 Feb. 2016, the entire disclosure of which is expressly incorporated by reference in its entirety herein.

BACKGROUND

The present disclosure relates to a field of waste management. More specifically, the present disclosure relates to an apparatus to press and dehydrate waste.

In the recent years, the amount of waste has increased sharply. This increase can be attributed to factors such as increased demand and production of livestock and agricultural produce, mismanagement, of livestock and agricultural produce, lack of proper waste management resources and the like. The waste primarily includes municipal waste, green waste, organic waste and the like. This waste occupies large sections of land. This waste does not decompose properly and affects the soil quality, air quality and water resource present in the vicinity. In addition, this waste is wet, has a bad odor and contains harmful bacteria. In addition, this occupancy of waste poses negative psychological impact on the neighborhood. To overcome this, the waste is pressed and dehydrated. In conventional treatment methods, the waste obtained from municipal dump areas is commonly transferred to multiple chambers equipped with helical ridges housed in large mechanical structures.

In the prior art, an apparatus is provided for dehydrating the pre-defined amount of waste using a screw press with a shear panel formed separately to remove liquid content. The apparatus using a screw press with a shear panel which is separately formed comprises a central shaft, a screw, a plurality of shear panels, and a shear blade. The screw is formed in a spiral shape on the outer circumference of the central shaft and dehydrates sludge by generating a compressive force as the sludge is transferred when the central shaft rotates. The shear panel is separated to the central shaft to be aligned to the outside of the screw and is fixed to the screw. The shear blade removes sludge solid bodies blocking a drum mesh, or a perforated hole as the central shaft in which the screw is attached rotates.

Other prior art includes an apparatus is provided for mechanically dewatering municipal sewage sludge or peat. The under watered feed, material is passed into the first end of a cylindrical porous wall and pressurized within the cylindrical wall by a rotating screw conveyor, which also transports the solids toward the second end of the cylindrical wall. The screw conveyor comprises a central, shaft which has at least two built-up sections of gradually increasing diameter providing a compression ratio of 2.5:1.0. The flight depth of the screw conveyor increases by a factor greater than 2.0 after each built-up section. The distance between the edge of the screw conveyor blade and the inner surface of the cylindrical wall and the structure of the openings in the wall have specific dimensional limitations. Fibrous additives may be used to aid in dewatering peat and secondary sludge.

Other prior art includes an apparatus is provided for de-watering waste. A main shaft is rotated about a longitudinal axis at a first rate. A screw shaft coupled to the main shaft is rotated about the longitudinal axis at the first rate. Screw fighting coupled to the screw shaft is rotated about the longitudinal axis at the first rate. A first and second stage drum is rotated, about the longitudinal axis at a second rate. Waste is introduced to a first area defined by an outer surface of the screw shaft and an inner surface of the first stage drum. Moisture is removed from the waste through a first slot coupled to the first stage drum. The waste is transported with the screw fighting from the first area to a second area defined by an outer surface of the screw shaft and an inner surface of the second stage drum, the second area being larger than the first area. Moisture is removed from the waste through a second slot coupled to the second stage drum.

Other prior art includes an apparatus is provided for separating waste liquid and solid material. The apparatus includes an upwardly inclined passage containing an auger for conveying the solid waste material upwardly along the passage, with an inlet opening at a lower end of the passage for receiving a mixture of waste liquid and solid material into the auger. In addition, the apparatus includes a drainage opening at the lower end of the cylindrical passage for draining liquid from the solid waste conveyed by the auger. In addition, the apparatus includes a compactor for receiving the solid material fed, upwardly by the auger and compacting the solid waste material. An extruder receives and extrudes the compacted solid waste material from the compactor, and may be arranged to convert the compacted material into pellets.

The prior art has several disadvantages. The apparatus mentioned in these prior arts have lower efficiency levels. Further, these apparatus have high fuel consumption and increased energy costs associated with inefficient operation. In addition, these apparatus fail to accommodate materials with non-uniform initial moisture content. In addition, these apparatus requires large size of chambers for accommodating organic waste. This consequent space requirements poses difficulty in transporting, assembling, and placing the apparatus in operation, particularly in remote locations. These apparatus are generally complex, require much manpower and are operationally uneconomical.

SUMMARY

In an aspect, the present disclosure provides an apparatus for pressing and dehydrating a pre-defined amount of waste. The apparatus includes a main frame positioned for providing a rigid support to the apparatus. Further, the apparatus includes a body mechanically linked to the main frame through a plurality of linkage plates. Furthermore, the apparatus includes an inlet vertically mounted on the body. Further, the apparatus includes a twin screw assembly mounted on the main frame and horizontally positioned for rotation along a longitudinal axis of the apparatus. Further, the apparatus includes a plurality of mesh screens rigidly linked to the main frame along the longitudinal axis of the apparatus. Moreover, the main frame is a metallic main frame. In addition, the body is designed to support rotation of the twin screw assembly. Further, the inlet has an ingress cross-sectional opening to receive the pre-defined amount of waste. In addition, the inlet has an egress cross-sectional opening to transfer the pre-defined amount of waste to the twin screw assembly. Further, the body includes a plurality of vertical rigid supports mounted perpendicular to the longitudinal axis of the apparatus. The plurality of vertical rigid supports is mounted vertically to the main frame. In addition, the plurality of vertical rigid supports provides vertical support to the apparatus. Moreover, the body includes one or more horizontal rigid supports mounted horizontally along the longitudinal axis of the apparatus. Furthermore, the twin screw assembly is configured to press and dehydrate the pre-defined amount of waste. Further, each mesh screen of the plurality of mesh screens includes a plurality of fishers for removing compressed liquid. In addition, the plurality of mesh screens encapsulates the twin screw assembly.

In an embodiment of the present disclosure, the main frame includes a first section for holding a driving unit and a second section for holding the body.

In an embodiment of the present disclosure, the twin screw assembly includes a first screw and a second screw positioned along the longitudinal axis of the apparatus. The first screw and the second screw are mechanically coupled to a driving shaft of the driving unit through a chain and sprocket assembly. Moreover, the first screw and the second screw include a first end and a second end. In addition, the first end is a near end and the second end is a far end. In addition, the twin screw assembly includes a plurality of helical ridges rigidly mounted on the first screw and the second screw. In addition, each helical ridge of the plurality of helical ridges has a pre defined progressive pitch varying from the first end to the second end.

In an embodiment of the present disclosure, the pre-defined progressive pitch is 120° at the first end. In addition, the pre-defined progressive pitch is 95° at the second end.

In an embodiment of the present disclosure, the driving unit is positioned adjacent to the body. In addition, the driving unit is mounted on the first section, of the main frame. Moreover, the driving unit is coupled to the chain and sprocket assembly.

In an embodiment of the present disclosure, the driving unit is an electric motor assembly.

In another embodiment of the present disclosure, the driving unit is an engine assembly.

In an embodiment of the present disclosure, the plurality of mesh screens includes a primary mesh screen and a secondary mesh screen. The secondary mesh screen surrounds the primary mesh screen circumferentially. Moreover, the plurality of mesh screens is a stainless steel mesh screen.

In an embodiment of the present disclosure, the primary mesh screen includes a first plurality of fishers of the plurality of fishers. The first plurality of fishers has a first pre-defined nominal diameter range. In addition, the first pre-defined nominal diameter range is 2 mm-4 mm.

In an embodiment of the present disclosure, the secondary mesh screen includes a second plurality of fishers of the plurality of fishers. The second plurality of fishers has a second pre-defined nominal diameter range. In addition, the second pre-defined nominal diameter range is 6 mm-8 mm.

In an embodiment of the present disclosure, the apparatus includes an outlet to expel a processed waste. Moreover, the outlet is positioned at the second end.

In another aspect, the present disclosure provides an apparatus for pressing and dehydrating a pre-defined amount of waste. The apparatus includes a main frame positioned for providing a rigid support to the apparatus. Further, the apparatus includes a body mechanically linked to the main frame through a plurality of linkage plates. Furthermore, the apparatus includes an inlet vertically mounted on the body. Further, the apparatus includes a twin screw assembly mounted on the main frame and horizontally positioned for rotation along a longitudinal axis of the apparatus. Further, the apparatus includes a plurality of mesh screens rigidly linked to the main frame along the longitudinal axis of the apparatus. Moreover, the main frame is a metallic main frame. In addition, the body is designed to support rotation of a twin screw assembly. Further, the inlet has an ingress cross-sectional opening to receive the pre-defined amount of waste. In addition, the inlet has an egress cross-sectional opening to transfer the pre-defined amount of waste to the twin screw assembly. Further, the body includes a plurality of vertical rigid supports mounted perpendicular to the longitudinal axis. The plurality of vertical rigid supports is mounted vertically to the main frame. In addition, the plurality of vertical rigid supports provides vertical support to the apparatus. Moreover, the body includes one or more horizontal rigid supports mounted horizontally along the longitudinal axis of the apparatus. Further, the twin screw assembly is configured to press and dehydrate the pre-defined amount of waste. The twin screw assembly includes a first screw and a second screw positioned along the longitudinal axis of the apparatus. The first screw and the second screw are mechanically coupled to a driving shaft of a driving unit through a chain and sprocket assembly. Moreover, the first screw and the second screw include a first end and a second end. In addition, the first end is a near end and the second end is a far end. Furthermore, the twin screw assembly includes a plurality of helical ridges rigidly mounted on the first screw and the second screw. In addition, each helical ridge of the plurality of helical ridges has a pre-defined progressive pitch varying from the first end to the second end. Further, each mesh screen of the plurality of mesh screens includes a plurality of fishers to remove compressed liquid from the pre-defined amount, of waste. In addition, the plurality of mesh screens encapsulates the twin screw assembly.

In an embodiment of the present disclosure, the pre-defined progressive pitch is 120° at the first end. In addition, the pre-defined progressive pitch is 95° at the second end.

In an embodiment of the present disclosure, the plurality of mesh screens includes a primary mesh screen and a secondary mesh screen. The secondary mesh screen surrounds the primary mesh screen circumferentially. Moreover, the plurality of mesh screens is a stainless steel mesh screen.

In an embodiment of the present disclosure, the primary mesh screen includes a first plurality of fishers of the plurality of fishers. The first plurality of fishers has a first pre-defined nominal diameter range. In addition, the first pre-defined nominal diameter range is 2 mm-4 mm.

In an embodiment of the present disclosure, the secondary mesh screen includes a second plurality of fishers of the plurality of fishers. The second plurality of fishers has a second pre-defined nominal diameter range. In addition, the second pre-defined nominal diameter range is 6 mm-8 mm.

In an embodiment of the present disclosure, the apparatus includes an outlet to expel a processed waste. Moreover, the outlet is positioned at the second end.

In yet another aspect, the present disclosure provides an apparatus for pressing and dehydrating a pre-defined amount of waste. The apparatus includes a main frame positioned for providing a rigid support to the apparatus. Further, the apparatus includes a body mechanically linked to the main frame through a plurality of linkage plates. Furthermore, the apparatus includes an inlet vertically mounted on the body. Further, the apparatus includes a twin screw assembly mounted on the main frame and horizontally positioned for rotation along a longitudinal axis of the apparatus. Further, the apparatus includes a plurality of mesh screens rigidly linked to the main frame along the longitudinal axis of the apparatus. Moreover, the main frame has a plurality of balance points. Also, the main frame is a metallic main frame. In addition, the main frame has a first section for holding a driving unit and a second section for holding the body. In addition, the body is designed to support rotation of the twin screw assembly. The body includes a plurality of vertical rigid supports mounted, perpendicular to the longitudinal axis of the apparatus. The plurality of vertical rigid supports is mounted vertically to the main frame. In addition, the plurality of vertical rigid supports provides vertical support to the apparatus. Moreover, the body includes one or more horizontal rigid supports mounted horizontally along the longitudinal axis of the apparatus. In addition, the body is designed to support rotation of the twin screw assembly. Further, the inlet has an ingress cross-sectional opening to receive the pre-defined amount of waste. In addition, the inlet has an egress cross-sectional opening to transfer the pre-defined amount of waste to the twin screw assembly. Further, the twin screw assembly is configured to press and dehydrate the pre-defined amount of waste. The twin screw assembly includes a first screw and a second screw positioned along the longitudinal axis of the apparatus. The first screw and the second screw are mechanically coupled to a driving shaft of the driving unit through a chain and sprocket assembly. Moreover, the first screw and the second screw include a first end and a second end. In addition, the first end is a near end and the second end is a far end. Furthermore, the twin screw assembly includes a plurality of helical ridges rigidly mounted on the first screw and the second screw. In addition, each helical ridge of the plurality of helical ridges has a pre-defined progressive pitch varying from the first end to the second end. Moreover, the pre-defined progressive pitch is 120° at the first end. In addition, the pre-defined progressive pitch is 95° at the second end. Further, each mesh screen of the plurality of mesh screens includes a plurality of fishers to remove compressed liquid from the pre-defined amount of waste. In addition, the plurality of mesh screens encapsulates the twin screw assembly. Moreover, the plurality of mesh screens includes a primary mesh screen and a secondary mesh screen. The secondary mesh screen surrounds the primary mesh screen circumferentially. In addition, the plurality of mesh screens is a stainless steel mesh screen.

In an embodiment of the present disclosure, the primary mesh screen includes a first plurality of fishers of the plurality of fishers. The first plurality of fishers has a first pre-defined nominal diameter range. In addition, the first pre-defined nominal diameter range is 2 mm-4 mm. Moreover, the secondary mesh screen includes a second plurality of fishers of the plurality of fishers. The second plurality of fishers has a second pre-defined nominal diameter range. In addition, the second pre-defined nominal diameter range is 6 mm-8 mm.

In an embodiment of the present disclosure, the apparatus includes an outlet to expel a processed waste. Moreover, the outlet is positioned at the second end.

BRIEF DESCRIPTION OF THE DRAWINGS

Figure 1A:
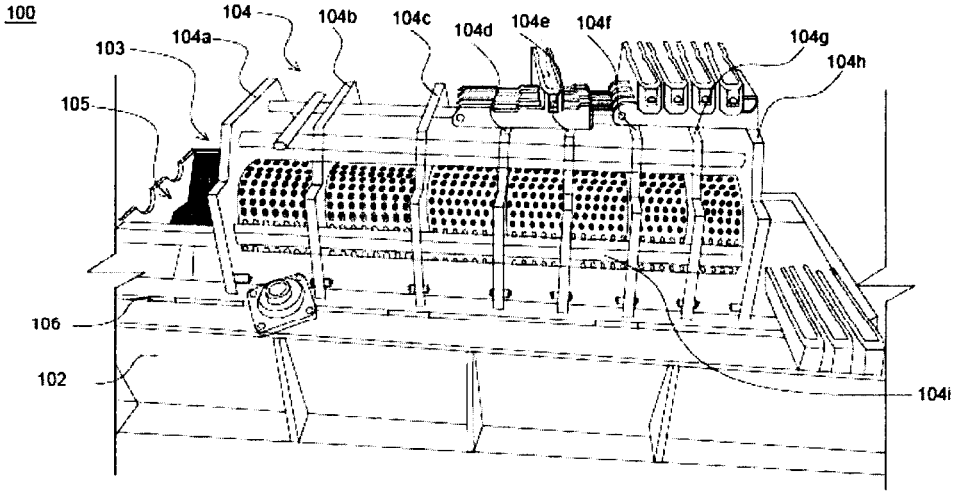
Figure 1B:
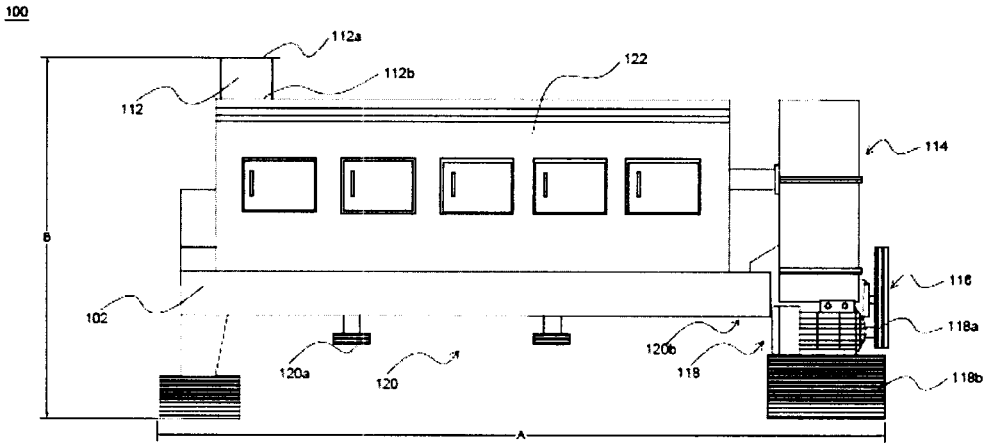
Figure 1C:
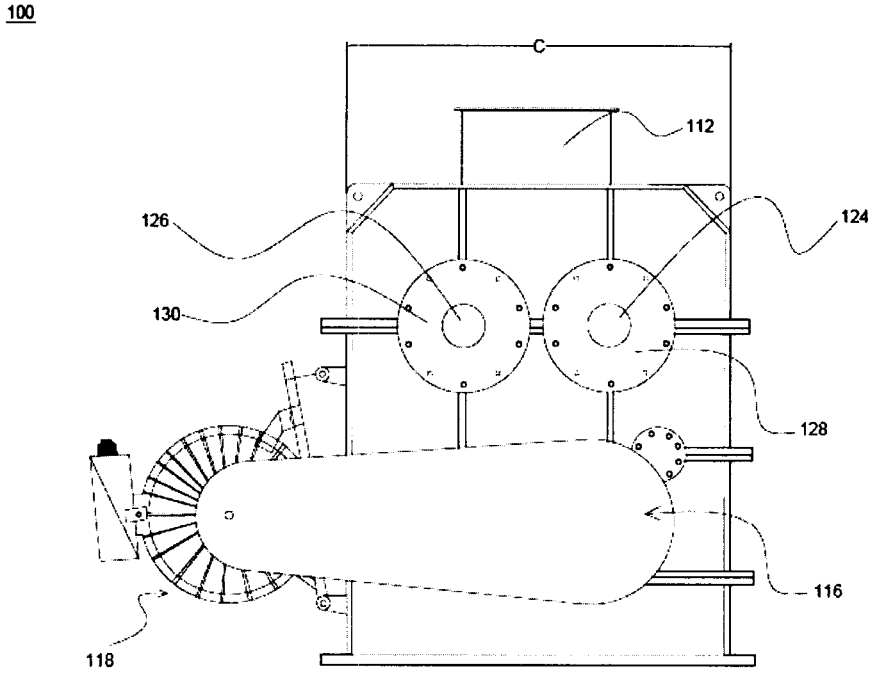
Figure 2A:
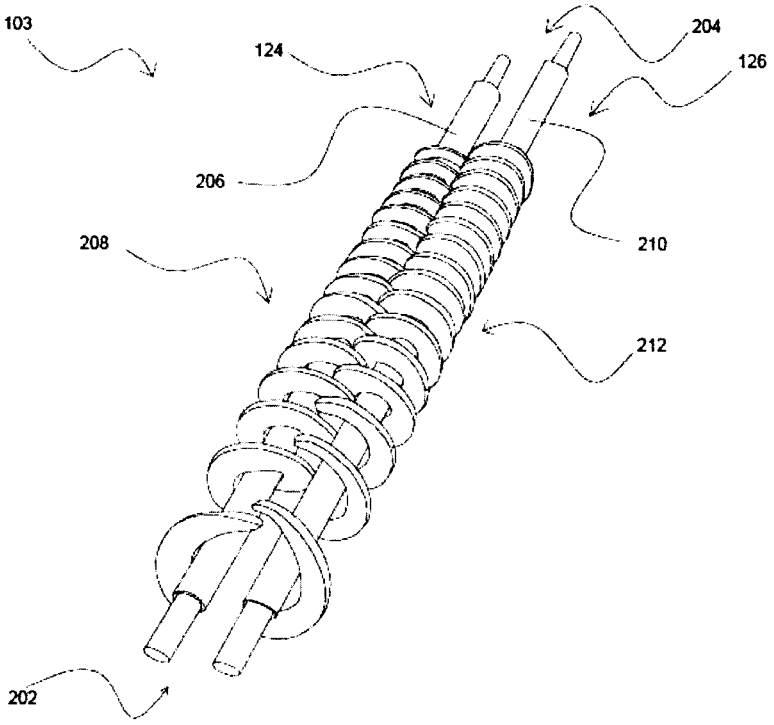
Figure 2B:
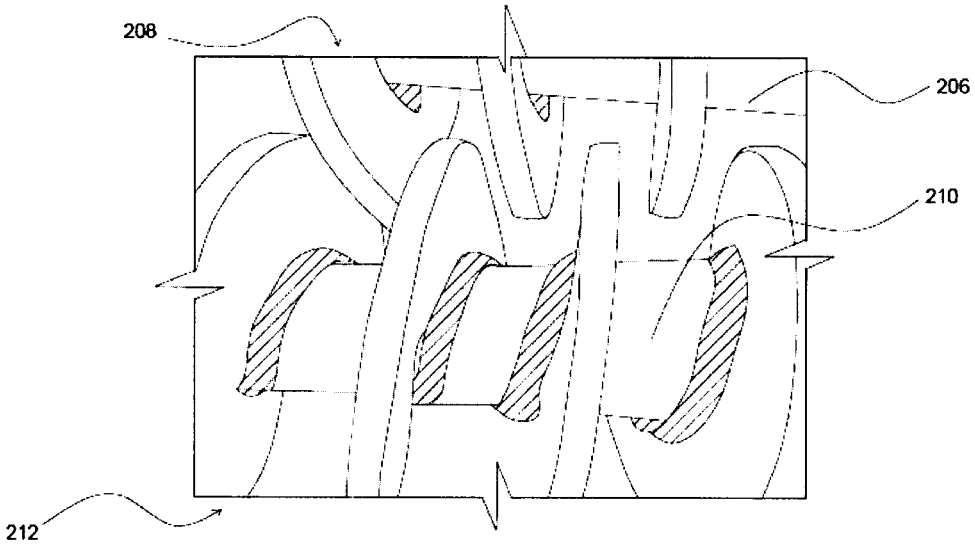
Figure 3:
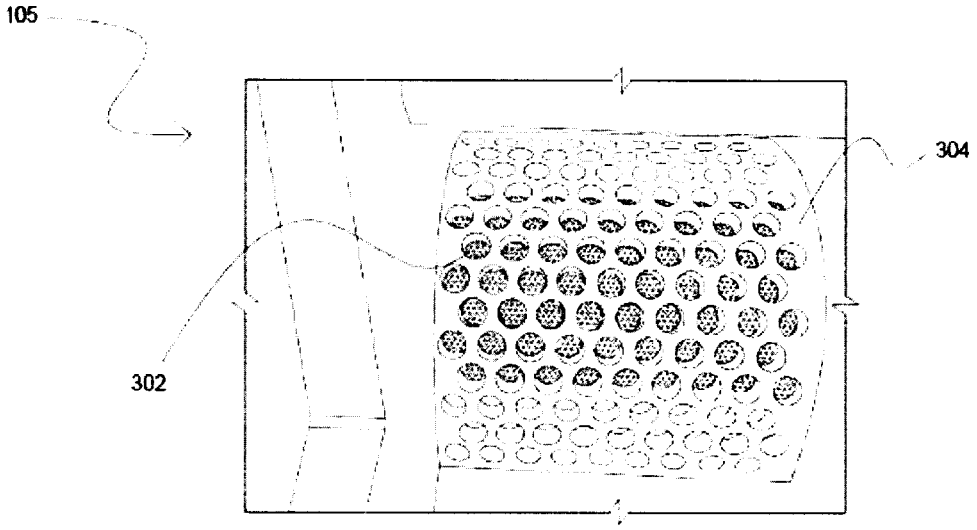
Figure 4:
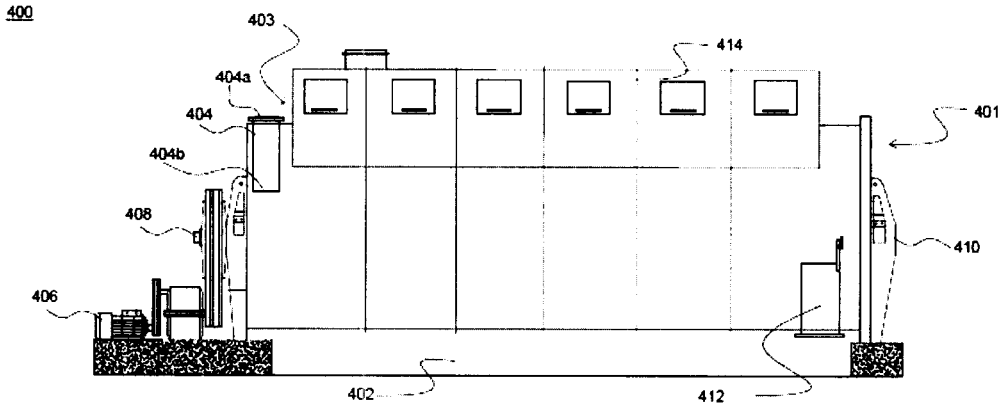
Figure 5A:
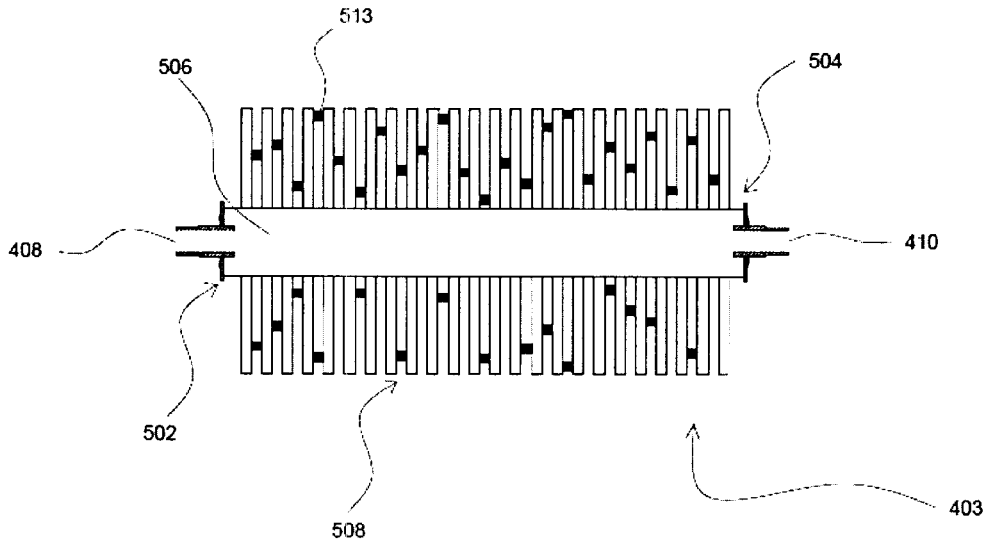

Having thus described the invention in general terms, reference will now be made to the accompanying drawings, which are not necessarily drawn to scale, and wherein:

FIG. 1A illustrates an internal perspective view of an apparatus for pressing and dehydrating a pre-defined amount of waste, in accordance with various embodiments of the present disclosure;

FIG. 1B illustrates a side profile view of the apparatus of FIG. 1A, in accordance with an embodiment of the present disclosure;

FIG. 1C illustrates a rear profile view of the apparatus of FIG. 1A, in accordance with another embodiment of the present disclosure;

FIG. 2A illustrates a perspective view of a twin screw assembly of the apparatus of FIG. 1A, in accordance with an embodiment of the present disclosure;

FIG. 2B illustrates a part perspective view of the twin screw assembly of the apparatus of FIG. 1A, in accordance with another embodiment of the present disclosure;

FIG. 3 illustrates the part perspective view of a plurality of mesh screens of the apparatus of FIG. 1A, in accordance with an embodiment of the present disclosure;

FIG. 4 illustrates a side profile view of another apparatus, in accordance with an embodiments of the present disclosure;

FIG. 5A illustrates a schematic view of a tumbler assembly of the apparatus of FIG. 4, in accordance with an embodiment of the present disclosure.

Figure 5B:
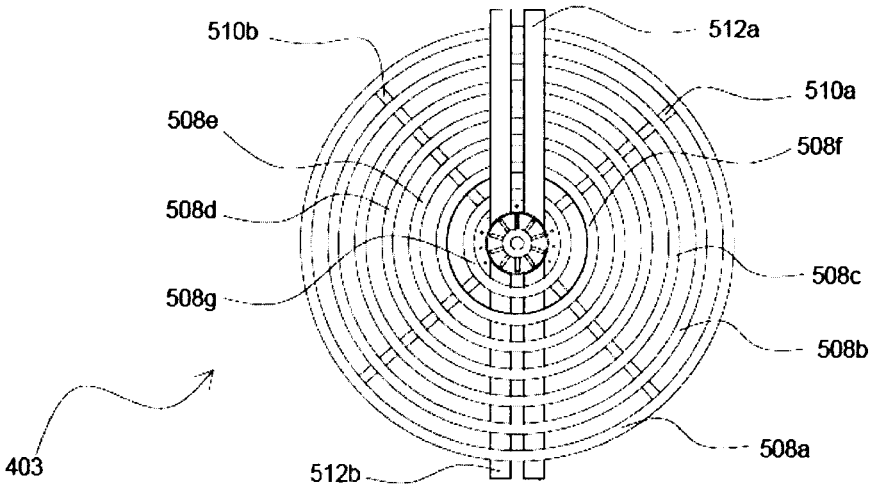

FIG. 5B illustrates a cross-sectional view of a tumbler assembly of the apparatus of FIG. 4, in accordance with an embodiment of the present disclosure.

Figure 5C:
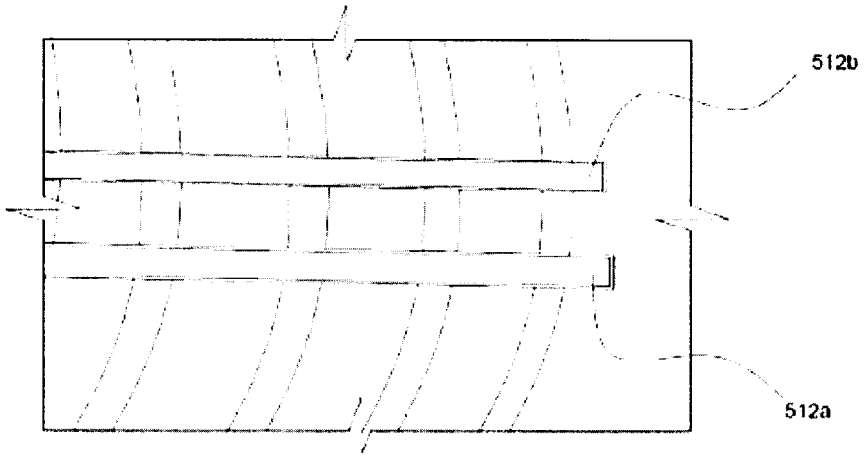

FIG. 5C illustrates the part perspective view of a tumbler assembly of the apparatus of FIG. 4, in accordance with an embodiment of the present disclosure.

Figure 5D:
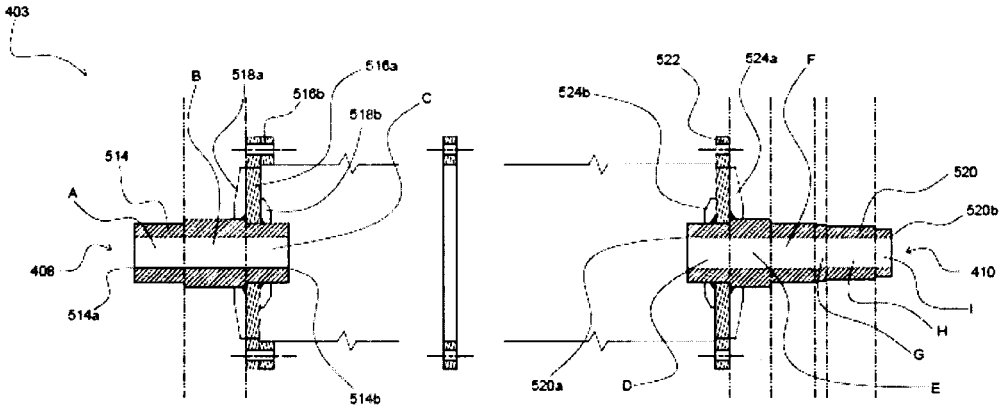

FIG. 5D illustrates a side sectional view of the tumbler assembly of the apparatus of the FIG. 4, in accordance with an embodiment of the present disclosure.

It should be noted that the accompanying figures are intended to present illustrations of exemplary embodiments of the present disclosure. These figures are not intended to limit the scope of the present disclosure. It should also be noted that accompanying figures are not necessarily drawn to scale.

DETAILED DESCRIPTION

Reference will now be made in detail to selected embodiments of the present disclosure in conjunction with accompanying figures. The embodiments described herein are not intended to limit the scope of the disclosure, and the present disclosure should not be construed as limited to the embodiments described. This disclosure may be embodied in different forms without departing from the scope and spirit of the disclosure. It should be understood that the accompanying figures are intended and provided to illustrate embodiments of the disclosure described below and are not necessarily drawn to scale. In the drawings, like numbers refer to like elements throughout, and thicknesses and dimensions of some components may be exaggerated for providing better clarity and ease of understanding.

It should be noted that the terms "first", "second", and the like, herein do not denote any order, quantity, or importance, but rather are used to distinguish one element from another. Further, the terms "a" and "an" herein do not denote a limitation of quantity, but rather denote the presence of at least one of the referenced item.

FIG. 1A illustrates an internal perspective view of an apparatus 100 for pressing and dehydrating of a pre-defined amount of waste, in accordance with various embodiments of the present disclosure. The apparatus 100 is a mechanical device configured to press and dehydrate the pre-defined amount of the waste. The pre-defined amount of waste is obtained from a plurality of sources. The pre-defined amount of waste includes waste livestock, animal excreta, municipal solid waste, green waste, organic waste and the like. In general, the pre-defined amount of waste primarily includes large solid mass of waste along with liquid content. In general, the apparatus 100 is an industrial presser designed to press and dehydrate the pre-defined amount of waste.

The apparatus 100 includes a main frame 102, a body 104, a plurality of linkage plates 106, a twin screw assembly 103 and a plurality of mesh screens 105. In addition, the apparatus 100 includes an inlet 112, a gear box assembly 114, a chain and sprocket assembly 116 and a driving unit 118 (shown in FIG. 1B and FIG. 1C). In addition, the apparatus 100 includes an outlet 120 and a press housing 122 (shown in FIG. 1B and FIG. 1C). The above mentioned parts of the apparatus 100 are designed and assembled to perform pressing and dehydrating of the pre-defined amount of waste.

Further, the apparatus 100 is substantially positioned along, a longitudinal axis. The apparatus 100 is rigidly supported by the main frame 102. The main frame 102 is a metallic frame positioned to provide support to the apparatus 100. Further, the main frame 102 includes a plurality of balance points. Each of the plurality of balance points is distributed discreetly across the main frame 102. Moreover, the main frame 102 includes a first section 102*a* for holding the body 104 of the apparatus 100. In addition, the main frame 102 includes a second section for holding the driving unit 118 (shown in the FIG. 1B and FIG. 1C).

The main frame 102 has a pre-defined length (D) (shown in FIG. 1B) to rigidly support the apparatus 100. In an embodiment of the present disclosure, the pre-defined length is 3680 mm. In another embodiment of the present disclosure, the pre-defined length is 4010 mm. In yet another embodiment of the present disclosure, the pre-defined length is 5700 mm.

The body 104 is aligned along the longitudinal axis of the apparatus 100. The body 104 includes a plurality of vertical rigid supports 104*a*-104*h* and one or more horizontal rigid supports 104*i*. The plurality of vertical rigid supports 104*a*-104*h* is mounted perpendicular to the longitudinal axis of the apparatus 100. In addition, the plurality of vertical rigid supports 104*a*-104*h* is mounted vertically to the main frame 102 of the apparatus 100. The plurality of vertical rigid supports 104*a*-104*h* provides vertical support to the apparatus 100. Moreover, the one or more horizontal rigid supports 104*i* are mounted along the longitudinal axis of the apparatus 100.

Furthermore, the body 104 is mechanically linked to the main frame 102 through the plurality of linkage plates 106. Moreover, the plurality of linkage plates 106 is horizontally positioned on the main frame 102. The plurality of linkage plates 106 is assembled discreetly across the main frame 102. Moreover, the plurality of linkage plates 106 is a metallic plate designed to provide a rigid and flat base for assembled parts of the apparatus 100. The body 104 includes a first plurality of holes. In addition, each linkage plate of the plurality of linkage plates 106 has a second plurality of holes designed to couple with a mountable part of the apparatus 100. In an embodiment of the present disclosure, the body 104 is the mountable part of the apparatus 100. The second plurality of holes of each linkage plate of the plurality of linkage plates 106 is aligned with the first plurality of holes of the body 104. Moreover, the body 104 is mechanically linked through insertion of a plurality of bolts inside the aligned first plurality of holes and the second plurality of holes.

Furthermore, a capacity to process the pre-defined amount of waste is based on a material handling capacity of the inlet 112 (as shown in FIG. 1B and FIG. 1C). In an embodiment of the present disclosure, the capacity of the apparatus 100 to process the pre-defined amount of waste is 350 tons per day. In another embodiment of the present disclosure, the capacity to process the pre-defined amount of the organic waste is 400 tons per day. In yet another embodiment of the present disclosure, the capacity to process the pre-defined amount of the organic waste is 800 tons per day.

Going further, the plurality of mesh screens 105 is rigidly linked to the body 104 along the longitudinal axis. The plurality of mesh screens is linked to the body 104 through the plurality of vertical rigid supports 104*a*-104*h*. In addition, the plurality of mesh screens is linked to the body 104 through the one or more horizontal rigid supports 104*i*. Moreover, the plurality of mesh screens 105 encapsulates the twin screw assembly 103. Each mesh screen of the plurality of mesh screens 105 has a pre-defined shape. In an embodiment of the present disclosure, the pre-defined shape of the plurality of mesh screens 105 is cylindrical. In another embodiment of the present disclosure, the pre-defined shape of the plurality of mesh screens 105 is cuboidal. In yet another embodiment of the present disclosure, each of the plurality of mesh screens 105 may have any suitable shape.

FIG. 1B illustrates a side profile view of the apparatus of the FIG. 1A, in accordance with an embodiment of the present disclosure. The inlet 112 is vertically mounted on the body 104 of the apparatus 100. The inlet 112 includes ingress cross-sectional opening 112*a* for receiving the pre-defined amount of waste. In addition, the inlet 112 includes an egress cross-sectional opening 112*b* for transferring the pre-defined amount of waste to the twin screw assembly 103. In an embodiment of the present disclosure, the ingress cross-sectional opening 112*a* is positioned above the egress cross-sectional opening 112*b*.

Further, the pre-defined amount of waste is gravitationally fed to the twin screw assembly 103 through the inlet 112. The pre-defined amount of waste is trapped between a first screw 124 and a second screw 126 (shown in FIG. 1C) of the twin screw assembly 103. Moreover, the twin screw assembly 103 compresses the pre-defined amount of waste with each rotation. In addition, the twin screw assembly 103 compresses the pre-defined amount of waste efficiently at a pre-defined speed of rotation. The pre-defined speed of rotation is controlled by the gear box assembly 114. The gear box assembly 114 is coupled to a first screw shaft 126*a* and a second screw shaft 128*a* (shown in FIG. 1C) of the twin screw assembly 103. In addition, the gear box assembly 114 is coupled to the chain and sprocket assembly 116. Moreover, the gear box 114 receives power from the driving unit 118. The gear box 114 receives the power from the driving unit 118 through the chain and sprocket assembly 116.

The driving unit 118 is positioned adjacent to the body 104 of the apparatus 100. In an embodiment of the present disclosure, the driving unit 118 is an electric motor. In another embodiment of the present disclosure the driving unit 118 is an engine. The driving unit 118 includes a driving shaft 118*a* and a driving unit mount 118*b*. The driving unit 118 is coupled with the driving shaft 118*a*. The driving unit 118 is configured to supply the power to the twin screw assembly 103 at a pre-defined rate of rotation. In addition, the driving shaft 118*a* is coupled to the chain and sprocket assembly 116. Moreover, the chain and sprocket assembly 116 is configured to transfer the power to the gear box 114.

In an embodiment of the present disclosure, the driving unit 118 is a direct current based motor. In another embodiment of the present disclosure, the driving unit 118 is an alternating current motor. Moreover, the pre-defined rate of rotation of the driving unit 118 may be controlled in any manner. In an embodiment of the present disclosure, the driving unit 118 is controlled through an automatic feedback based controller. In another embodiment of the present disclosure, the driving unit 118 is controlled through a manual switch based controller.

Furthermore, the driving unit 118 is mounted on the driving unit mount 118*b*. The driving unit mount 118*b* is positioned adjacent to the body 104 and mounted on the first section of the main frame 102. The driving unit mount 118*b* includes a plurality of holders designed to mount the driving unit 118. Moreover, the outlet 120 includes a press liquid outlet 120*a* and a press solid outlet 120*b*. The press liquid outlet 120*a* is mechanically, linked to the main frame 102 of the apparatus 100. The press liquid outlet 120*a* is configured to expel a compressed liquid content of the pre-defined amount of waste. In addition, the press solid outlet 120*b* is mechanically linked to the main frame 102 at the second end 110 of the body 104. The press solid outlet 120*b* is configured to expel a compressed solid waste of the pre-defined amount of waste.

Further, the press housing 122 encloses the body 104, the twin screw assembly 103 and the plurality of mesh screens 105. The press housing 122 has a pre-defined shape. In an embodiment of the present disclosure, the pre-defined shape of the plurality of mesh screens 105 is cylindrical. In another embodiment of the present disclosure, the pre-defined shape of the plurality of mesh screens 105 is cuboidal. In yet another embodiment of the present disclosure, each of the plurality of mesh screens 105 may have any suitable shape. Further, the press housing 122 is made of a metal or an alloy. In an embodiment of the present disclosure, the metal used for construction of the press, housing 122 is steel. In another embodiment of the present disclosure, the metal used for construction of the press housing 122 is galvanized iron. In yet another embodiment of the present disclosure, any suitable metal or alloy may be used for the construction of the press housing 122.

FIG. 1C illustrates a rear profile view of the apparatus of the FIG. 1A, in accordance with another embodiment of the present disclosure. The first screw 124 and the second screw 126 extends outside the body 104. A first annular base plate 128 supports the first screw 124. In addition, the first annular base plate 128 is configured to align properly with the first screw 124. Moreover, a second annular base plate 130 supports the second screw 126. In addition, the second annular base plate 130 is configured to align properly with the second screw 126.

Furthermore, the apparatus 100 has a pre-defined height (shown as B in FIG. 1B), a pre-defined length (shown as A in FIG. 1B) and a pre-defined width (shown as C in FIG. 1C). In an embodiment of the present disclosure, the apparatus 100 has the pre-defined height (B) of 2110 millimeters, the pre-defined length (A) of 4565 millimeters and the pre-defined width (C) of 1315 millimeters. In another embodiment of the present disclosure, the apparatus 100 has the pre-defined height (B) of 2115 millimeters, the pre-defined length (A) of 4850 millimeters and the pre-defined width (C) of 1330 millimeters. In yet another embodiment of the present disclosure, the apparatus 100 has the pre-defined height (B) of 2650 millimeters, the pre-defined length (A) of 6850 millimeters and the pre-defined width (C) of 1840 millimeters.

In addition, the driving unit 118 operating the twin screw assembly 103 in the apparatus 100 consumes a pre-defined amount of power. In an embodiment of the present disclosure, the pre-defined amount of the power is 37 kilowatt for the capacity of 350 tons per day. In another embodiment of the present disclosure, the pre-defined amount of power is 45 kilowatt for the capacity of 400 tons per day. In yet another embodiment of the present disclosure, the pre-defined amount of power is 55 kilowatts for the capacity of 800 tons per day.

FIG. 2A illustrates a perspective view of the twin screw assembly 103 of the apparatus of the FIG. 1A, in accordance with an embodiment of the present disclosure. The twin screw assembly 103 includes the first screw 124 and the second screw 126. The first screw 124 and the second screw 126 are positioned along the longitudinal axis of the apparatus 100. Further, the first screw 124 and the second screw 126 include a first end 202 and a second end 204. In an embodiment of the present disclosure, the first end 202 is a near end. In an embodiment of the present disclosure, the second end 204 is a far end.

Further, the first screw 124 includes a first screw shaft 206 and a first plurality of helical ridges 208. The first screw shaft 206 extends from the first end 202 to the second end 204. Moreover, the first screw shaft 206 has a first pre-defined size at the first end 202. In addition, the first screw shaft 206 has a second pre-defined size at the second end 204. In an embodiment of the present disclosure the first pre-defined size at the first end 202 is greater than the second pre-defined size at the second end 204 (shown in FIG. 2B). Moreover, the first screw shaft 206 is coupled to the gear box assembly 114.

The first plurality of helical ridges 208 is mounted on the first screw shaft 206. In an embodiment of the present disclosure, the first plurality of helical ridges 208 has a right hand thread. In another embodiment of the present disclosure, the first plurality of helical ridges 208 has a left hand thread. Furthermore, the first plurality of helical ridges 208 has a first pre-defined progressive pitch. The first pre-defined progressive pitch varies from the first end 202 to the second end 204. In an embodiment of the present disclosure, the first pre-defined progressive pitch is 120° at the first end 202. In an embodiment of the present disclosure, the first pre-defined progressive pitch is 95° at the second end 204.

Further, the second screw 126 includes a second screw shaft 210 and a second plurality of helical ridges 212. The second screw shaft 210 extends from the first end 202 to the second end 204. Moreover, the second screw shaft 210 has a third pre-defined size at the first end 202. In addition, the second screw shaft 206 has a fourth pre-defined size at the second end 204. In an embodiment of the present disclosure, the third pre-defined size at the first end 202 is greater than the fourth pre-defined size at the second end 204 (shown in FIG. 2B). Moreover, the second screw shaft 210 is coupled to the gear box assembly 114.

The second plurality of helical ridges 212 is mounted on the second screw shaft 210. In an embodiment of the present disclosure, the second plurality of helical ridges 212 has a left hand thread. In another embodiment of the present disclosure, the second plurality of helical ridges 212 has a right hand thread. Furthermore, the second plurality of helical ridges 212 has a second pre-defined progressive pitch. The second pre-defined progressive pitch varies from the first end 202 to the second end 204. In an embodiment of the present disclosure, the second pre-defined progressive pitch is 120° at the first end 202. In an embodiment of the present disclosure, the second pre-defined progressive pitch is 95° at the second end 204. In an embodiment of the present disclosure, the first plurality of helical ridges 208 and the second plurality of helical ridges 212 partially overlap each other.

FIG. 3 illustrates a part perspective view of the plurality of mesh screens 105 of the apparatus of FIG. 1A, in accordance with an embodiment of the present disclosure. The plurality of mesh screens 105 is rigidly linked to the body 104 along the longitudinal axis (as shown in FIG. 1A). The plurality of mesh screens 105 is linked to the body 104 through the plurality of vertical rigid supports 104*a*-104*h* (as shown in FIG. 1A). In addition, the plurality of mesh screens 105 is linked to the body 104 through the one or more horizontal rigid supports 104*i* (as shown in FIG. 1A). Moreover, the plurality of mesh screens 105 encapsulates the twin screw assembly 103. The plurality of mesh screens 105 is configured to remove the compressed liquid content of the pre-defined amount of waste. In an embodiment of the present disclosure, the plurality of mesh screens 105 is a stainless steel mesh screen.

Further, the plurality of mesh screens 105 includes a primary mesh screen 302 and a secondary mesh screen 304. In an embodiment of the present disclosure, the secondary mesh screen 304 surrounds the primary mesh screen 302 circumferentially. The primary mesh screen 302 has a first plurality of fishers. The first plurality of fishers has a first pre-defined nominal diameter range. In an embodiment of the present disclosure, the first pre-defined nominal diameter range is 2 mm-4 mm. Moreover, the secondary mesh screen 304 has a second plurality of fishers. The second plurality of fishers has a second pre-defined nominal diameter range. In an embodiment of the present disclosure, the second pre-defined nominal diameter range is 6 mm-8 mm.

FIG. 4 illustrates a side profile view of another apparatus 400 for drying the pre-defined amount of waste, in accordance with an embodiment of the present disclosure. The apparatus 400 is a mechanical machine configured to collect and dry the pre-defined amount of the waste. The apparatus 400 utilizes indirect dry steam to kill bacteria and viruses present in the pre-defined amount of waste. In general, the apparatus 400 is an industrial dryer designed to dry the pre-defined amount of waste.

Further, the apparatus 400 includes a machinery frame 402, a heating chamber 401, a meal inlet 404, a tumbler assembly 403 (shown in FIG. 5) and a motor 406. In addition, the apparatus 400 includes a steam inlet 408, a steam outlet 410, a processed material outlet 412 and a dryer housing 414. The apparatus 400 is rigidly supported by the machinery frame 402. The machinery frame 402 is a metallic frame positioned to provide support to the apparatus 400.

Further, the meal inlet 402 is mounted vertically to the heating chamber 401. The meal inlet includes a feed inlet section 404*a* and a feed discharge section 404*b*. The meal inlet 404 receives the pre-defined amount of waste through the feed inlet section 404*a*. In addition, the meal inlet 404 transfers the pre-defined amount of waste to the heating chamber 401 through the feed discharge section 404*b*. In an embodiment of the present disclosure, the feed inlet section 404*a* and the feed discharge section 404*b* of the meal inlet 404 has a rectangular cross-section. It may be noted that the meal inlet 404 has a rectangular cross-section; however, those skilled in the art would appreciate that the feed inlet section 404*a* and the feed discharge section 404*b* of the meal, inlet 404 may have any cross section. The feed inlet section 404*a* of the meal inlet 404 is open vertically upwards. Moreover, the heating chamber 401 is a metallic chamber positioned adjacent to the length of the apparatus 400. In addition, the heating chamber 401 is rigidly linked to the machinery frame 402.

The heating chamber 401 is a hollow cylinder with a pre-defined nominal diameter. In an embodiment of the present disclosure, the pre-defined nominal diameter is 2880 mm. In addition, the heating chamber 401 has a pre-defined heating surface area. In an embodiment of the present disclosure the pre-defined heating surface area is 370 square meter. In another embodiment of the present disclosure, the pre-defined heating surface area is 422 square meter. In addition, the weight of the apparatus 400 depends on the material handling capacity of the heating chamber 401. In an embodiment of the present disclosure, the weight of the apparatus 400 is 28000 kilograms. In another embodiment of the present disclosure, the weight of the apparatus 400 is 30000 kilograms.

Further, the heating chamber 401 encloses the tumbler assembly 403 (shown in FIG. 5). The tumbler assembly 403 is positioned along a longitudinal axis of the heating chamber 401. The tumbler assembly 403 (shown in FIG. 5) is configured to dry the pre-defined amount of waste. In addition, the tumbler assembly 403 (shown in FIG. 5) rotates at a pre-defined speed to dry the pre-defined amount of waste. The tumbler assembly 403 (shown in FIG. 5) is connected to the motor 406. The motor 406 is an electric motor designed to rotate at a pre-defined speed. Moreover, the motor 406 includes a motor shaft. The motor shaft is attached to the tumbler assembly 403 (shown in FIG. 5). The motor shaft is positioned to rotate the tumbler assembly 403 at a pre-defined range of a speed of rotation.

In an embodiment of the present disclosure, the motor 406 is an alternating current motor. In another embodiment of the present disclosure, the motor 406 is a direct current motor. In addition, the motor 406 is connected through a motor controller. The motor controller directs electric power and provides regulated current to the motor 406. The regulated current determines a rate of rotation of the motor 406. In an embodiment of the present disclosure, the motor controller is a manual controller. In another embodiment of the present disclosure, the motor controller is an automatic controller.

Going further, the tumbler assembly 403 is mechanically connected to the steam inlet 408. The steam inlet 408 is positioned at a third end (shown in FIG. 5) of the tumbler assembly 403. The steam inlet 408 collects a pre-defined amount of dry steam from a steam boiler. The steam inlet 408 is designed to collect the pre-defined amount of dry steam inside a hollow shaft (shown in FIG. 5) of the tumbler assembly 403. Moreover, the steam outlet 410 is positioned at a fourth end (shown in FIG. 5) of the tumbler assembly 403. The steam outlet 410 is positioned along an axis synchronized with the longitudinal axis of the heating chamber 401. Further, the steam outlet 410 is internally connected to the tumbler assembly 403 (shown in FIG. 5). The steam outlet 410 transfers a condensed steam present inside the tumbler assembly 403 to one or more feeding pipes. In addition, the one or more feeding pipes transfer the condensed steam from the tumbler assembly 403 to the steam boiler.

Further, the processed material outlet 412 is substantially attached to a bottom of the heating chamber 401. In addition, the processed material outlet 412 faces downwards with an axis perpendicular to the longitudinal axis of the heating chamber 401. Moreover, the processed material outlet 412 is characterized by a processed material opening. The processed material opening has a rectangular cross section. In an embodiment of the present disclosure, the processed material opening of the processed material outlet 412 may have any cross-section. Further, the processed material outlet 412 is designed to eject the pre-defined amount of organic waste subjected to drying treatment.

Furthermore, the dryer housing 414 is positioned adjacent to the longitudinal axis of the heating chamber 401. The dryer housing 414 is a metallic case designed to enclose the tumbler assembly 403. Moreover, the apparatus 400 has a pre-defined height (shown as B in FIG. 4) and a pre-defined length (shown as A in FIG. 4). In an embodiment of the present disclosure, the apparatus 400 has the pre-defined height (B) of 10080 millimeters and the apparatus length (A) of 11600 millimeters. In another embodiment of the present disclosure, the apparatus 400 has the pre-defined height (B) of 11080 millimeters and the pre-defined length (A) of 12600 millimeters.

Going further, the motor 406 operating the tumbler assembly 403 in the apparatus 400 consumes a pre-defined amount of power. In an embodiment of the present disclosure, the pre-defined amount of the power is 90 kilowatt. In another embodiment of the present disclosure, the pre-defined amount of power is 110 kilowatt.

FIG. 5A illustrates a schematic view of the tumbler assembly 403 of the apparatus of the FIG. 4, in accordance with an embodiment of the present disclosure. The tumbler assembly 403 includes a third end 502, a fourth end 504, a hollow shaft 506, a plurality of group of concentric rings 508, a plurality of reinforcement members 510*a*-510*b*, a plurality of return pipes 512*a*-512*b* and a plurality of angular blocks 513. Moreover, a plurality of parts of the tumbler assembly 403 is designed to efficiently dry the pre-defined amount of waste.

The hollow shaft 506 of the tumbler assembly 403 is positioned along an axis synchronized with the longitudinal axis of the heating chamber 401. The hollow shaft 506 extends from the third end 502 to the fourth end 504 of the tumbler assembly 403. The hollow shaft 506 is designed to receive dry steam from the steam inlet 408 of the apparatus 400. Moreover, the hollow shaft 506 is designed to receive steam at a pre-defined pressure. In an embodiment of the present disclosure, the pre-defined pressure is 6 bars. In addition, the hollow shaft 506 is designed to transfer the condensed steam to the steam outlet 410 of the apparatus 400. Moreover, the hollow shaft 506 is designed to disperse the steam inside the plurality of group of concentric rings 508 of the tumbler assembly 403. In an embodiment of the present disclosure, the hollow shaft 506 is made of non-alloy quality steel. In another embodiment of the present disclosure, the hollow shaft 506 is made of any suitable material. In an embodiment of the present disclosure, the hollow shaft has a pre-defined diameter of 610 mm and a pre-defined length of 9720 mm.

The plurality of group of concentric rings 508 is mechanically mounted to the hollow shaft 506. In an embodiment of the present disclosure, the plurality of group of concentric rings 508 is mounted perpendicular to a longitudinal axis of the hollow shaft 506. In another embodiment of the present disclosure, the plurality of group of concentric rings 508 is oriented slightly off-center with respect to the hollow shaft 506. In yet another embodiment of the present disclosure, the plurality of group of concentric rings 508 is mounted at a pre-defined angular range with respect to the longitudinal axis of the hollow shaft 506. In an embodiment of the present disclosure, the pre-defined angular range is 85°-95°.

Further, each of the plurality of group of concentric rings 508 includes a plurality of concentric rings 508*a*-508*g* (as shown in FIG. 5B). Each of the plurality of group of concentric rings 508 has a pre-defined amount of the plurality of concentric rings. In an embodiment of the present disclosure, the pre-defined amount of the plurality of concentric rings 508*a*-508*g* is in a range of 3-20. Each concentric ring of the plurality of concentric rings 508*a*-508*g* is designed to disperse the steam for efficient drying of the pre-defined amount of waste (as shown in FIG. 5B). In addition, each concentric ring of the plurality of concentric rings 508*a*-508*g* is connected to the hollow shaft 506 through a plurality of pipes. The plurality of pipes is designed to transfer the steam from the hollow shaft 506 to each concentric ring of the plurality of concentric rings 508*a*-508*g* (as shown in FIG. 5B) Moreover, each concentric ring of the plurality of concentric rings 508*a*-508*g* encapsulates a steam injector for regulating steam.

In an embodiment of the present disclosure, each concentric ring of the plurality of concentric rings 508*a*-508*g* is made of non-alloy quality steel. In an embodiment of the present disclosure, each concentric ring of the plurality of concentric rings 508*a*-508*g* has a pre-defined tube diameter of 60 mm (as shown in FIG. 5C). In an embodiment of the present disclosure, concentric ring 508*a* has a pre-defined nominal diameter of 2540 mm. In an embodiment of the present disclosure, concentric ring 508*b* has a pre-defined nominal diameter of 2270 mm. In an embodiment of the present disclosure, concentric ring 508*c* has a pre-defined nominal diameter of 2000 mm. In an embodiment of the present disclosure, concentric ring 508*d* has a pre-defined nominal diameter of 1730 mm. In an embodiment of the present disclosure, concentric ring 508*e* has a pre-defined nominal diameter of 1460 mm. In an embodiment of the present disclosure, concentric ring 508*f* has a pre-defined nominal diameter of 1190 mm. In an embodiment of the present disclosure, concentric ring 508*g* has a pre-defined nominal diameter of 920 mm. In addition, each concentric ring of the plurality of concentric rings 508*a*-508*g* is connected to the plurality of reinforcement members 510*a*-510*b*. Each reinforcement member of the plurality of reinforcement members 510*a*-510*b* is designed to provide rigid strength to the tumbler assembly 403. In addition, each reinforcement member of the plurality of reinforcement members 510*a*-510*b* is rigidly linked to each concentric ring of the plurality of concentric rings 508*a*-508*g*. In an embodiment of the present disclosure, each reinforcement member of the plurality of reinforcement members 510*a*-510*b* is made of hot rolled steel.

Furthermore, the plurality of return pipes 512*a*-512*b* (as shown in FIG. 5B, FIG. 5C) is mechanically connected to each group of the plurality of group of concentric rings 508. In an embodiment of the present disclosure, each return pipe of the plurality of return pipes 512*a*-512*b* is made of the non-alloy quality steel. In another embodiment of the present disclosure, each return pipe of the plurality of return pipes 512*a*-512*b* can be made of any suitable material. In addition, each return pipe of the plurality of return pipes 512*a*-512*b* is connected at a pre-defined distance from each other. In an embodiment of the present disclosure, the pre-defined distance is 50 mm. The plurality of return pipes 512*a*-512*b* (as shown clearly in FIG. 5C) is designed to capture and return the condensed steam to the hollow shaft 506. In an embodiment of the present disclosure, each return pipe of the plurality of return pipes 512*a*-512*b* has a pre-defined nominal diameter of 90 mm (as shown in FIG. 5C). Moreover, each return pipe of the plurality of return pipes 512*a*-512*b* has a pre-defined wall thickness. In an embodiment of the present disclosure, the pre-defined wall thickness is 8 mm. In addition, each return pipe of the plurality of return pipes 512*a*-512*b* is made of a pre-defined material. In an embodiment of the present disclosure, the pre-defined material is a non-alloy quality steel.

The plurality of angular blocks 513 is mechanically mounted to each group of the plurality of group of concentric rings 508. The plurality of angular blocks 513 is mounted at a plurality of angles and at a plurality of positions with respect to each group of the plurality of group of concentric rings 508. The plurality of angular blocks 513 is designed to agitate and move the pre-defined amount of waste forward inside the apparatus 400.

FIG. 5D illustrates a side sectional view of the tumbler assembly 403 of the apparatus of the FIG. 4, in accordance with an embodiment of the present disclosure. In addition, the FIG. 5D illustrates a detailed sectional view of the steam inlet 408 and the steam, outlet 410 associated with the tumbler assembly 403. The steam inlet 408 includes an inlet shaft 514, a first inlet flange 516*a*, a second inlet flange, a first inlet support 518*a* and a second inlet support 518*b*. Further, the inlet shaft 514 is a hollow cylindrical shaft designed to allow the steam to enter the hollow shaft 506 at the pre-defined pressure. The inlet shaft 514 is made of a pre-defined material. In an embodiment of the present disclosure, the pre-defined material is AISI 1050 carbon steel. In another embodiment of the present disclosure, the pre-defined material can be any suitable material.

Furthermore, the inlet shaft 514 includes a first inlet end 514*a* and a second inlet end 514*b*. In an embodiment of the present disclosure, the first inlet end 514*a* and a second inlet end 514*b* are positioned at a pre-defined distance of 613 mm from each other. In addition, the inlet shaft 514 includes a section A, a section B and a section C. In an embodiment of the present disclosure, the section A has a pre-defined length of 253 mm and a pre-defined nominal diameter of 220 mm. In an embodiment of the present disclosure, the section B has a pre-defined length of 242 mm and a pre-defined nominal diameter of 250 mm. In an embodiment of the present disclosure, the section C has a pre-defined length of 118 mm and a pre-defined nominal diameter of 240 mm.

The first inlet flange 516*a* and the second inlet flange 516*b* are mounted at the section C of the inlet shaft 514. In an embodiment of the present disclosure, the first inlet flange 516*a* and the second inlet flange 516*b* are made of hot rolled steel. In another embodiment of the present disclosure, the first inlet flange 516*a* and the second inlet flange 516*b* can be made of any suitable material. In an embodiment of the present disclosure, the first inlet flange 516*a* has a nominal diameter of 810 mm and a thickness of 38 mm. In an embodiment of the present disclosure, the second inlet flange 516*b* has a nominal diameter of 810 mm and a thickness of 38 mm. Moreover, a pre-defined number of holes of pre-defined diameter are drilled circumferentially on the first inlet flange 516*a* and, the second inlet flange 516*b*. In an embodiment of the present disclosure, the pre-defined number of holes is 24. In an embodiment of the present disclosure, the pre-defined diameter of each hole is 24 mm.

Furthermore, the first inlet support 518*a* and the second inlet support 518*b* are rigidly linked to the section B, the section C, the first inlet flange 516*a* and the second inlet flange 516*b*. The first inlet support 518*a* and the second inlet support 518*b* are designed to rigidly support the first inlet flange 516*a* and the second inlet flange 516*b*. In addition, the first inlet support 518*a* and the second inlet support 518*b* are positioned to rigidly fix the first inlet flange 516*a* and the second inlet flange 516*b*. In an embodiment of the present disclosure, the first inlet support 518*a* and the second inlet support 518*b* are made of the hot rolled steel. In another embodiment of the present disclosure, the first inlet support 518*a* and the second inlet support 518*b* can be made of any suitable material. In an embodiment of the present disclosure, each of the first inlet support 518*a* and the second inlet support 518*b* has a pre-defined thickness of 30 mm.

Going further, the steam outlet 410 includes an outlet shaft 520, an outlet flange 522, a first outlet support 524*a* and a second outlet support 524*b*. The outlet shaft 520 is a hollow cylindrical shaft designed to allow the steam to exit through the hollow shaft 506 at the pre-defined pressure. The outlet shaft 520 is made of a pre-defined material. In an embodiment of the present disclosure, the pre-defined material is AISI 1050 carbon steel. In another embodiment of the present disclosure, the pre-defined material can be any suitable material.

Furthermore, the outlet shaft 520 includes a first outlet end 520*a* and a second outlet end 520*b*. In an embodiment of the present disclosure, the first outlet end 520*a* and a second outlet end 520*b* are positioned at a pre-defined distance of 893 mm from each other. In addition, the outlet shaft 520 includes a section D, section E, section F, section G, section H and section I. In an embodiment of the present disclosure, the section D has a pre-defined, length of 118 mm and a pre-defined nominal diameter of 240 mm. In an embodiment of the present disclosure, the section E has a pre-defined length of 243.9 mm and a pre-defined nominal diameter of 250 mm. In an embodiment of the present disclosure, the section F has a pre-defined length of 117.2 mm and a pre-defined nominal diameter of 220 mm. In an embodiment of the present disclosure, the section G has a pre-defined length of 103.9 mm and a pre-defined nominal diameter of 210 mm. In an embodiment of the present disclosure, the section H has a pre-defined length of 250 mm and a pre-defined nominal diameter of 200 mm. In an embodiment of the present disclosure, the section I has a pre-defined length of 60 mm and a pre-defined nominal diameter of 180 mm.

The outlet flange 522 is mounted at the section D of the outlet shaft 520. In an embodiment of the present disclosure, the outlet flange 522 is made of hot rolled steel. In another embodiment of the present disclosure, the outlet flange 522 can be made of any suitable material. In an embodiment of the present disclosure, the outlet flange 522 has a nominal diameter of 810 mm and a thickness of 38 mm. Moreover, a pre-defined number of holes of pre-defined diameter are drilled circumferentially on the outlet flange 522. In an embodiment of the present disclosure, the pre-defined number of holes is 24. In an embodiment of the present disclosure, the pre-defined diameter of each hole is 24 mm.

Furthermore, the first outlet support 524*a* and the second outlet support 524*b* are rigidly linked to the section D, the section E and the outlet flange 522. The first outlet support 524*a* and the second outlet support 524*b* are designed to rigidly support the outlet flange 522. In addition, the first outlet support 524*a* and the second outlet support 524*b* are positioned to rigidly fix the outlet flange 522. In an embodiment of the present disclosure, the first outlet support 524*a* and the second outlet support 524*b* are made of the hot rolled steel. In another embodiment of the present disclosure, the first outlet support 524*a* and the second outlet support 524*b* can be made of any suitable material. In an embodiment of the present disclosure, each of the first outlet support 524*a* and the second outlet support 524*b* has a pre-defined thickness of 30 mm.

Further, the present apparatus has several advantages over the prior art. The present apparatus provides compactly and sophistically pressed and dried waste with an increased processing efficiency. Further, the apparatus derives a lower power with an increased output. Thus, the apparatus provides a higher return of investment and an easier finance of resources. Furthermore, the use of the apparatus has various ecological benefits. The apparatus decreases the volume of the waste. In addition, the apparatus provides a solution to the growing problem of large scale waste dumping. Ultimately, the apparatus leads to a reduction in emissions of greenhouse gases (GHG) and possibly a complete elimination of landfills.

The foregoing descriptions of specific embodiments of the present technology have been presented for purposes of illustration and description. They are not intended to be exhaustive or to limit the present technology to the precise forms disclosed, and obviously many modifications and variations are possible in light of the above teaching. The embodiments were chosen and described in order to best explain the principles of the present technology and its practical application, to thereby enable others skilled in the art to best utilize the present technology and various embodiments with various modifications as are suited to the particular use contemplated. It is understood that various omissions and substitutions of equivalents are contemplated as circumstance may suggest or render expedient, but such are intended to cover the application or implementation without departing from the spirit or scope of the claims of the present technology.

While several possible embodiments of the invention have been described above and illustrated in some cases, it should be interpreted and understood as to have been presented only by way of illustration and example, but not by limitation. Thus, the breadth and scope of a preferred embodiment should not be limited by any of the above-described exemplary embodiments.

What is claimed is:

1. An apparatus for drying waste, comprising:
a tumbler assembly housed within a heating chamber;
the tumbler assembly dries a predefined amount of waste by conduction;
the tumbler assembly includes:
one or more hollow members that are heated from within to dry a predefined amount of waste by conduction;
the one or more hollow members include:
a hollow shaft that is heated by dry steam; and
a plurality of additional conduction surfaces includes:
a plurality of hollow rings mechanically connected along a longitudinal axis of the hollow shaft that receive the dry steam from the hollow shaft to efficiently transmit heat to dry the predefined amount of waste in contact with the hollow shaft and the hollow ring; and
a set of return pipes connected to each hollow ring of the plurality of hollow rings, which return the dry steam from the plurality of hollow rings back to hollow shaft.

2. The apparatus for drying waste as set forth in claim 1, wherein:
the one or more hollow members include:
a hollow shaft that is heated;
a plurality of additional conduction surfaces in a form of at least one hollow ring mechanically connected along a longitudinal axis of the hollow shaft that receive the heat from the hollow shaft to efficiently transmit heat to dry the predefined amount of waste in contact with the hollow shaft and the hollow ring.

3. The apparatus for drying waste as set forth in claim 1, wherein:
a set of blocks externally connects the plurality of hollow rings to agitate and move the predefined amount of waste forward inside the heating chamber.

4. The apparatus for drying waste as set forth in claim 1, wherein:
the tumbler assembly further includes a set of rigid reinforcement members linked to a hollow ring of the plurality of hollow rings providing added strength to the plurality of hollow rings.

5. An apparatus for drying waste, comprising:
a main frame positioned for providing a rigid support to the apparatus;
a heating chamber rigidly linked to the main frame;
a main inlet including a feed inlet section and a feed discharge section;
a predefined amount of waste is received via the main inlet and into the feed inlet section, and is transferred via the feed discharge section to a tumbler assembly of the heating chamber to dry the pre-defined amount of waste;
the tumbler assembly rotates at a predefined speed by a motor connected to a motor controller;
the tumbler assembly is comprised of a hollow shaft, which is connected to a steam inlet to receive dry steam at a predefined pressure;
the steam inlet directs dry steam inside the hollow shaft of the tumbler assembly, with dry steam existing the hollow shaft of the tumbler assembly via a steam outlet;
the tumbler assembly is further comprised of:
a plurality of hollow rings mechanically connected along a longitudinal axis of the hollow shaft that receive the dry steam from the hollow shaft to efficiently transmit heat to dry the predefined amount of waste in contact with the hollow shaft and the hollow ring; and
a set of return pipes connected to each hollow ring of the plurality of hollow rings, which return the dry steam from the plurality of hollow rings back to hollow shaft.

6. The apparatus for drying waste as set forth in claim 5, wherein:
a set of blocks externally connects the plurality of hollow rings to agitate and move the predefined amount of waste forward inside the heating chamber.

7. The apparatus for drying waste as set forth in claim 5, wherein:
the tumbler assembly further includes a set of rigid reinforcement members linked to a hollow ring of the plurality of hollow rings providing added strength to the plurality of hollow rings.

8. The apparatus for drying waste as set forth in claim 5, wherein:
the tumbler assembly is connected to a rotating shaft of the motor to rotate the tumbler assembly.

9. The apparatus for drying waste as set forth in claim 5, wherein:
the inlet steam includes a hollow inlet shaft.

10. The apparatus for drying waste as set forth in claim 5, wherein:
the outlet steam includes a hollow outlet shaft.

11. The apparatus for drying waste as set forth in claim 5, wherein:
the tumbler assembly is an enclosed mechanism with one entry opening for ingress of dry steam and one exist opening for egress of dry stream.

12. The apparatus for drying waste as set forth in claim 11, wherein:
the entry opening for ingress of dry steam is a hollow inlet shaft and exist opening for egress of dry steam is a hollow outlet shaft.

* * * * *